United States Patent [19]

McIntosh

[11] 4,307,821

[45] Dec. 29, 1981

[54] CONTAINER-CLOSURE ASSEMBLY

[75] Inventor: James A. McIntosh, Montclair, N.J.

[73] Assignee: Mack-Wayne Plastics Company, Wayne, N.J.

[21] Appl. No.: 180,371

[22] Filed: Aug. 22, 1980

[51] Int. Cl.[3] ..... B65B 7/24

[52] U.S. Cl. ..... 222/83; 215/256; 220/270

[58] Field of Search ..... 215/256, 254, 217, 218, 215/330, 340; 220/270, 276; 206/222; 222/81, 83, 153, 541

[56] References Cited

U.S. PATENT DOCUMENTS

| | | | |
|---|---|---|---|
| 3,182,858 | 5/1965 | Beaudoin | 222/83 |
| 3,955,716 | 5/1976 | Goncalves . | |
| 4,058,232 | 11/1977 | Ohno et al. | 215/224 X |

*Primary Examiner*—George T. Hall

*Attorney, Agent, or Firm*—Eugene E. Renz, Jr.

[57] ABSTRACT

A container-closure assembly comprising a container having a body portion and an elongated externally threaded neck at one end having a discharge opening normally closed by a membrane, a locking collar at the juncture of the neck and body portion projecting radially beyond the circumferential trace of the threads of the neck of the container and a closure adapted to be mounted over the discharge end of the container comprising a cap portion of generally cup-like form having internal threads and a piercing element projecting from the inside face of the top of the container and a skirt of a larger diameter than the cap connected to the lower edge of the cap by fracturable bridge means and locking means at the lower terminal edge of the skirt cooperating with the locking collar to prevent removal of the closure from the container.

5 Claims, 7 Drawing Figures

CONTAINER-CLOSURE ASSEMBLY

BACKGROUND OF THE INVENTION

The present invention relates to container-closure assemblies and more specifically to a novel combination which is extremely economical to manufacture and is effective for the purposes intended.

The present invention relates particularly to a container-closure combination adapted for packaging pharmaceuticals or the like. Some of these containers are provided with a so-called blind end or membrane and the closure has a piercing element which can be actuated to puncture the membrane to permit discharge of the packaged product. In this way a pharmaceutical product may be packaged in a sterile, enclosed environment and the closure actuated on demand by a doctor or hospital personnel to release the product when needed. The closure is usually provided with some visual indicating means to indicate to the user that the membrane has been punctured and thereby the container-closure assembly is characterized as being tamper-proof.

Container-closures of this type are not new per se. For example the Henderson U.S. Pat. No. 2,771,218 shows a closure-assembly for pharmaceutical, medicinal and biological preparations packaged in a container with a blind end or a membrane. In this instance the closure-cap which is threadedly received on the container has a central conical piercing tip which in the unarmed position of the assembly is spaced from the membrane and is maintained in that position by means of lugs projecting from the sidewall or finish of the container in one embodiment so that when it is desired to arm the container and puncture the membrane, the cap is simply threaded downwardly to fracture the radially projecting ribs on the container and permit the closure or cap to be actuated to a position wherein the membrane is punctured by the piercing element.

In another form of the invention, the cap is provided with a series of axially projecting frangible legs which engage the body of the container below the neck in the unarmed position. Now when the cap is rotated, the leg members are fractured to permit the piercing element to puncture the membrane. While this assembly is generally effective for the purposes intended, it is, nevertheless, possible with this type of container-closure assembly to remove the closure and reapply it after puncturing the membrane and there is, therefore, no visual indicia that the assembly has been tampered with.

Another so-called collapsible tube-type container with a membrane is shown in the Ferris U.S. Pat. No. 3,109,562. This assembly simply has a collar which is removably mounted on the outer end of the cap which must be removed to permit arming of the assembly. This provides some visual indicia. However, it presupposes that the user is aware that the cap includes the removable tear band portion.

SUMMARY OF THE INVENTION

With the foregoing in mind, an object of the present invention is to provide a container-closure assembly which is truly tamper-proof and wherein the cap or closure cannot be effectively removed from the container without giving visual evidence that the cap had been once removed.

To this end the container includes an elongated body portion, a threaded neck at one axial end of the body portion terminating in a discharge end which is normally closed by a puncturable membrane. The closure member includes a cap portion which is internally threaded to mate with the threads on the container neck and has a piercing element depending from the inner face of the top which normally overlies the membrane on the container and an enlarged skirt portion connected by fracturable means to the lower terminal edge of the cap. The closure is detachably secured at the skirt portion to the container in a manner so that it only can be removed by fracturing or destroying the skirt portion thereby providing truly tamper-proof visual indicating means. Specifically, the skirt has an internal locking bead or rib which engages in a locking collar at the juncture of the neck of the container and body portion. The skirt also includes a pull-tab and axial scoring which connects with a fracturable bridge section at the juncture of the skirt and cap to permit easy and quick removal of the skirt by the users by a simple pulling and stripping action.

BRIEF DESCRIPTION OF THE DRAWING

These and other objects of the present invention and the various features and details of the construction and operation of a container-closure assembly in accordance with the present invention are hereinafter more fully set forth with reference to the accompanying drawings, wherein.

BRIEF DESCRIPTION OF THE PREFERRED EMBODIMENT

Figure 6:
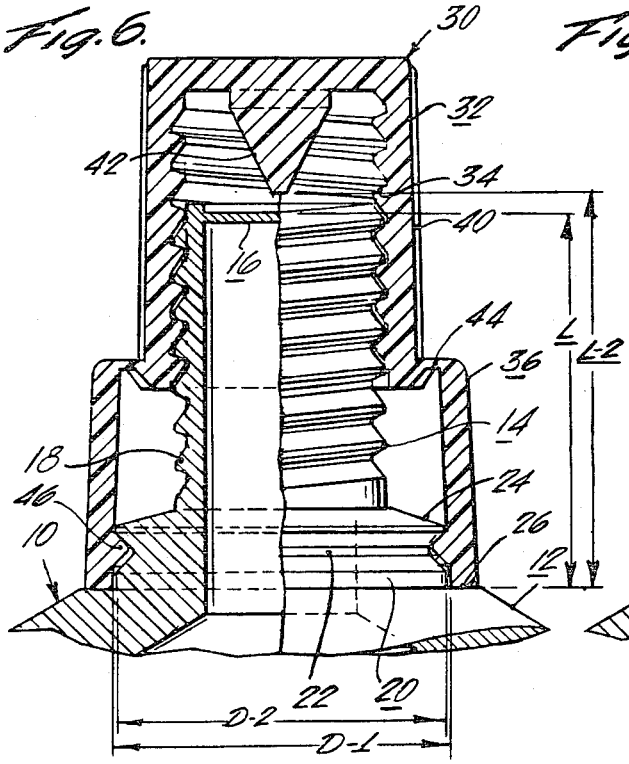
FIG. 6 is an enlarged view partly in section of the container-closure assembly in accordance with the present invention showing the closure in an assembled position prior to arming or puncturing the diaphragm.

Referring now to the drawing and particularly to FIG. 6 thereof, there is illustrated a container-closure assembly in accordance with the present invention generally designated by the numeral 10. The container has a generally elongated cylindrical tube-like body portion 12, a threaded neck 14 projecting from one axial end of the body portion 12 which is closed at its terminal end by a puncturable diaphragm 16. As is typical, the body portion 12 is designed to be collapsible and therefore, these containers are typically made of a soft metal such as lead, tin or antimony or alloys thereof or a suitable plastic material. As illustrated, the neck of the container has external threads 18 and an enlarged locking collar 20 at the juncture of the body portion 12 and neck 14. The collar 20 has an annular groove 22 formed therein and an outwardly divergent conical top face 24 projecting radially outwardly from the lower edge of the neck 14. The body portion also has a circumferentially extending radially directed flat 26 defining an abutment shoulder at the juncture of the collar 20 of the body portion 12.

The closure generally designated by the numeral 30 is generally of cup-like form and comprises a top or cap portion 32 having internal threads 34 which cooperate and coact with the threads 18 on the neck of the container to permit assembly and disassembly of the cap and an enlarged lower skirt portion 36. The cap portion 32 has a knurled external finish as at 40 to facilitate gripping and rotation of the cap by the user. As illustrated the cap 32 includes a piercing element in the form of a pointed conical projection 42 depending from the inside surface of the top portion of the cap which aligns axially with the axis of the neck of the container. This piercing element is adapted to penetrate the membrane 16 when it is desired to dispense the container contents.

Figure 2:
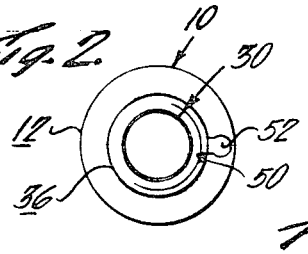
FIG. 2 is a top plan view of the container-closure assembly of the present invention.
Figure 1:
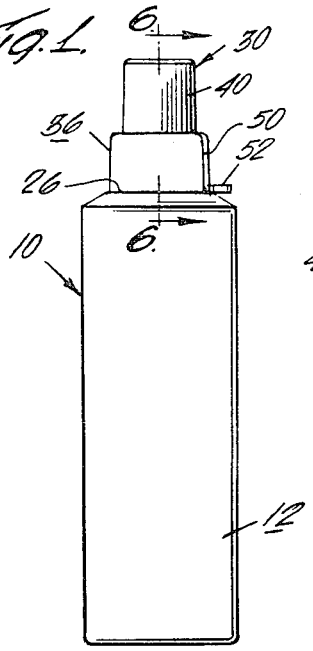
FIG. 1 is a side elevational view of a container-closure assembly embodying features of the present invention.
Figure 3:
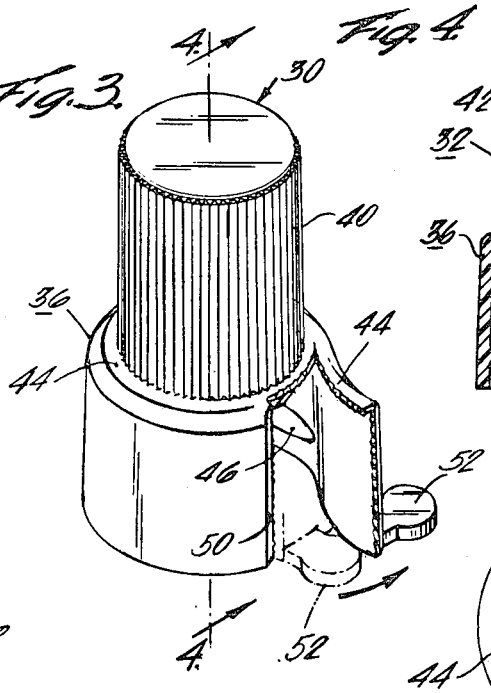
FIG. 3 is an enlarged prospective view of the closure cap.
Figure 4:
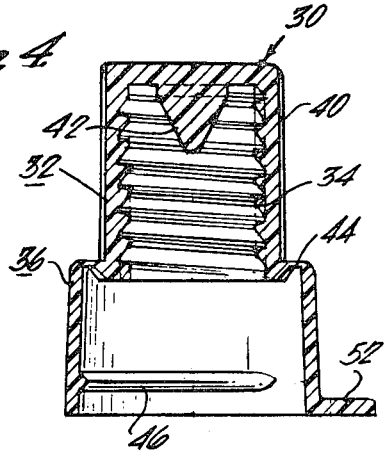
FIG. 4 is a sectional view taken on lines 4—4 of FIG. 3.
Figure 5:
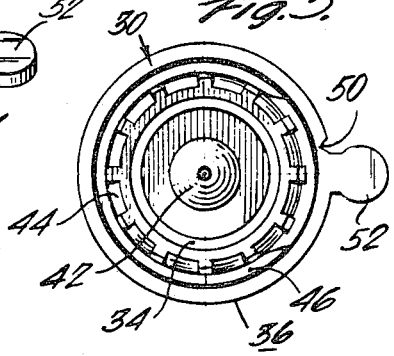
FIG. 5 is a bottom plan view of the closure cap.

As illustrated, the skirt 36 is of a diameter greater than the diameter of the cap portion 32 and is connected thereto by a thin circumferentially extending fracturable wall 44, the juncture of the cap portion and the upper peripheral edge of the skirt. The skirt has an axial score line 50 extending the full height of the skirt and a pull tab 52 is provided which projects radially outwardly from the lower edge to provide gripping means for the user when it is desired to remove the skirt to permit arming of the cap portion 32. The skirt also has an internal circumferentially extending bead or rib 46 which seats in the groove 22 to retain the closure assembly in place. As illustrated in FIG. 3, rib 46 does not extend for the entire circumference of the skirt, but terminates on either side of axial score line 50 to facilitate separation of the skirt along this score line.

Figure 7:
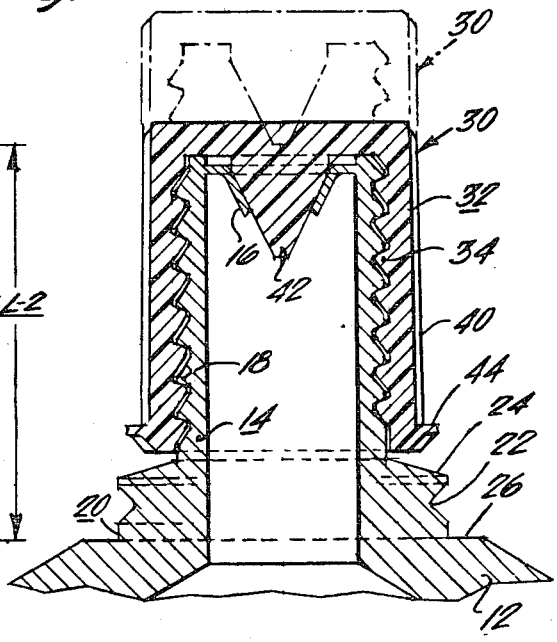
FIG. 7 is an enlarged sectional view similar to FIG. 6 showing the cap in a fully seated or armed position.

The closure 30 is preferably made of a plastic material which can be molded easily and economically. Considering now operation and use of the container-closure assembly incorporating the features of the present invention. As is customary, the containers are filled with a pharmaceutical or a medicament product and then the lower portion of the container is sealed. The closure 30 is then assembled by simply applying it to the threaded neck of the container and turning it in a direction to seat the cap 32. In the present instance, the enlarged skirt 36 easily clears the container threads 18 and does not offer an impediment to turning the cap onto the neck of the container. Note also that the skirt 36 is slightly outwardly flared and that the internal diameter D-1 of the skirt at its lower edge is greater than the largest diameter D-2 of the locking collar adjacent the lower end of the neck of the container. Thus, the lower edge of the skirt 36 easily clears the collar and now as the beveled lower face of the rib 46 engages the complementary cam face 24 of the locking collar, the skirt is slightly outwardly deflected to permit passage of the bead 46 over the top edge of the locking collar until it seats in the groove. In this position the lower edge of the skirt is flush with the shoulder 26 on the container and the bead or rib 46 presses under tension in the groove 22. This firmly seats the closure in place so that it may not be removed without giving some evidence of being tampered with. Note that in this position the axial dimension L from the membrane 16 to the shoulder 26 is less than the axial dimension L-1 of the cap from the tip of the piercing element 42 to the lower edge of the skirt so that when the cap is fully seated, the piercing element 42 is spaced from the membrane 16 in an unarmed position as illustrated in FIG. 6. Now when it is desired to dispense the container contents, the user simply pulls the tab 52 at the lower edge of the skirt outwardly whereby the skirt is initially separated along the axial scoring 50 and then continues to exert an outward and circumferential pull on the tab thereby to effect complete separation of the skirt from the upper portion of the container along the circumferential fracturable bridge connection 44 in the manner illustrated and shown by the arrows in FIG. 3. Note that this leaves a somewhat jagged edge at the lower end of the cap which is visual indicia to the user that the cap construction has been altered and that the container contents may have been exposed to the outside environment. The user can then simply rotate the cap further inwardly to the position shown in FIG. 7 whereby the piercing element punctures the membrane to provide a discharge opening in the axial end of the container.

The container-closure assembly of the present invention has particular application in the packaging of pharmaceuticals or medicaments that have a relatively short shelf life once the contents are exposed to the environment. For example, with the closure completely intact, the user knows that the contents have been maintained in a sealed, sterile condition whereas with the lower skirt removed and the jagged edges of the cap exposed, the user now knows that the container membrane may have been punctured and that the contents probably have been exposed to the environment.

In summary, therefore, the present invention provides a truly tamper-proof means for container-closure assemblies. The container-closure assembly is particularly adapted for packaging sterile products such as medicaments and guarantees sterility of the product up to the end user. In these instances, the blind end container and cap are manufactured and sent to the pharmaceutical company for filling. The pharmaceutical company then fills the container from the lower end and seals it at that end under aseptic conditions. The closure cap is then sterilized and assembled under aseptic conditions. Thus, when the product is opened by the user, the sterility of the product is assured. Specifically the discharge end of the container and particularly the membrane and cap are guaranteed to be sterile and will not contaminate any part of the product when the membrane is punctured by the piercing element to discharge the product.

While the particular embodiment of the present invention has been illustrated and described herein, it is not intended to limit the invention and changes and modifications may be made therein within the scope of the following claims.

What is claimed is:

1. A container-closure assembly comprising a container having a body portion and an elongated externally threaded neck at one end having a discharge opening normally closed by a membrane, a locking collar at the juncture of the neck and body portion projecting radially beyond the circumferential trace of the threads on the neck of the container and a closure adapted to be mounted over the discharge end of the container comprising a cap portion of generally cup-like form having internal threads and a piercing element projecting from the inside face of the top of the container and a skirt of a larger diameter than the cap connected to the lower edge of the cap by fracturable bridge means and locking means at the lower terminal edge of the skirt cooperating with the locking collar to prevent removal of the closure from the container.

2. A container-closure assembly as claimed in claim 1 wherein said fracturable bridge means comprises an annular score line at the juncture of the skirt and cap portion and an axial score line extending from said annular score line to the lower terminal edge of the skirt.

3. A container-closure assembly as claimed in claim 2 including a tab on the closure skirt which projects radially from the bottom edge of the skirt and is located adjacent said axial score line to serve as a lever to separate the skirt from the cap portion.

4. A container-closure assembly as claimed in claim 1 including a continuous annular groove in the said locking collar and said skirt includes a rib on the inner face thereof adapted to seat in said groove to lock the closure in place.

5. A container-closure assembly as claimed in claim 4 on either side of an axial score line in said skirt forming part of said fracturable bridge means for ease of separation along said score line.

* * * * *